US010314440B2

(12) United States Patent
Rochette et al.

(10) Patent No.: US 10,314,440 B2
(45) Date of Patent: Jun. 11, 2019

(54) BATHTUB WITH DOOR AND DRAIN

(71) Applicant: LES PRODUITS NEPTUNE INC., Saint-Hyacinthe (CA)

(72) Inventors: Jean Rochette, Longueuil (CA); Alexandre Marchand, Longueuil (CA); Marc Veilleux, St-Liboire (CA); Luc Beaupré, Sherbrooke (CA); Alain Deslauriers, Drummondville (CA); Patrick Charbonneau, St-Jude (CA)

(73) Assignee: LES PRODUITS NEPTUNE INC., St-Hyacinthe (CA)

( * ) Notice: Subject to any disclaimer, the term of this patent is extended or adjusted under 35 U.S.C. 154(b) by 0 days.

(21) Appl. No.: 15/771,733

(22) PCT Filed: May 30, 2017

(86) PCT No.: PCT/CA2017/050658

§ 371 (c)(1),
(2) Date: Apr. 27, 2018

(87) PCT Pub. No.: WO2017/205974

PCT Pub. Date: Dec. 7, 2017

(65) Prior Publication Data

US 2019/0075975 A1 Mar. 14, 2019

Related U.S. Application Data

(60) Provisional application No. 62/343,241, filed on May 31, 2016.

(51) Int. Cl.
*A47K 3/02* (2006.01)
*A47K 3/00* (2006.01)
(Continued)

(52) U.S. Cl.
CPC ..... *A47K 3/006* (2013.01); *A47K 3/024* (2013.01); *E03C 1/23* (2013.01); *E03C 1/2302* (2013.01);
(Continued)

(58) Field of Classification Search
CPC ..... A47K 3/006; E03C 1/23; E03C 1/2302; E03C 2001/2311; E03C 2001/2317
(Continued)

(56) References Cited

U.S. PATENT DOCUMENTS 5,163,187 A 11/1992 Dannenberg
5,220,696 A 6/1993 Dannenberg
(Continued)

FOREIGN PATENT DOCUMENTS

CA 2036967 A1 9/1991
CA 2081980 A1 11/1991
(Continued)

OTHER PUBLICATIONS

ISR and WO PCT/CA2017/050658.

*Primary Examiner* — Huyen D Le
(74) *Attorney, Agent, or Firm* — Gonzalo Lavin

(57) ABSTRACT

A bathtub comprising a tub having an enclosure defined by at least one sidewall for holding a water capacity, a doorway on the sidewall for providing access to the tub, a door mountable onto the doorway for holding at least two water levels in the tub; an actuator allowing a user to move the door between at least three positions; a mechanical drain for emptying the tub, a double reservoir for receiving water from the tub through the drain and the door drip, a control interface, door position sensors, water level detection sensors, a pressure sensor, and a controller configured to receive input controls signals from the control interface, receive input door lock position signals, receive input water detec-
(Continued)

tion signals, receive input pressure signals, send control signals to control a sealing valve of the door, and send control signals for operating a drain valve.

24 Claims, 12 Drawing Sheets

(51) Int. Cl.
*A47K 3/024* (2006.01)
*E03C 1/23* (2006.01)

(52) U.S. Cl.
CPC ..... *E03C 2001/2311* (2013.01); *E03C 2001/2317* (2013.01)

(58) Field of Classification Search
USPC ..... 4/556
See application file for complete search history.

(56) References Cited

U.S. PATENT DOCUMENTS

| | | | | | |
|---|---|---|---|---|---|
| 5,446,929 | A * | 9/1995 | Sills | A47K 3/006 | 4/555 |
| 5,549,149 | A | 8/1996 | Sills | | |
| 5,701,614 | A * | 12/1997 | Appleford | A47K 3/006 | 4/555 |
| 7,237,276 | B2 | 7/2007 | Longman | | |
| 8,230,534 | B2 | 7/2012 | Torres | | |
| 8,863,323 | B2 | 10/2014 | Knapp | | |
| 9,254,066 | B2 | 2/2016 | Torres | | |
| 9,585,524 | B2 | 3/2017 | Knapp et al. | | |
| 2004/0064883 | A1 * | 4/2004 | Appleford | A47K 3/006 | 4/555 |
| 2007/0067901 | A1 | 3/2007 | Longman | | |
| 2011/0167555 | A1 | 7/2011 | Zierler | | |
| 2012/0198611 | A1 | 8/2012 | Zierler | | |
| 2015/0020305 | A1 | 1/2015 | Knapp | | |

FOREIGN PATENT DOCUMENTS

| | | | |
|---|---|---|---|
| CA | 2775240 | A1 | 7/2012 |
| CN | 202610909 | | 12/2012 |
| CN | 102630148 | B | 7/2015 |
| DE | 3508713 | C2 | 1/1994 |
| DE | 102011000676 | A1 | 8/2012 |
| FR | 2962895 | A1 | 1/2012 |
| JP | H1033617 | | 2/1998 |
| JP | 2000303529 | | 10/2000 |
| JP | 2000342468 | | 12/2000 |
| WO | WO2013125477 | | 8/2013 |
| WO | WO2015198280 | | 12/2015 |

* cited by examiner

BATHTUB WITH DOOR AND DRAIN

CROSS-REFERENCE TO RELATED APPLICATIONS

This application is a National Entry Application of PCT application No. PCT/CA2017/050658 filed on May 30, 2017 and published in English under PCT Article 21(2), which itself claims priority to U.S. provisional Patent application Ser. No. 62/343,241 filed on May 31, 2016. All documents above are incorporated herein in their entirety by reference.

TECHNICAL FIELD

The present application relates to a bathtub with a slide-down door for easy access by individuals. In particular, the present invention relates to a bathtub that provides an easy access, especially for older people that have lesser autonomy, reduced mobility or who require help for taking a bath.

BACKGROUND

Several models of relatively accessible bathtubs exist in the market, mostly with an access threshold that is lowered with respect to the ground. However, what exists in the market is suitable only for a short period of use. Indeed, such bathtubs do not adapt well with the physical degeneration of the user's age (loss of independence, need of a walker, need of a wheelchair) and become practically unusable if bathing assistance becomes necessary. In addition, people with lessening autonomy often feel embarrassed when visitors or other users of the bathroom see such a bathtub due to its appearance that is reminiscent of hospital furniture.

Other bathtub models are better suited for people who need a walker or wheelchair or are disabled or the like. Those known bathtubs use a side door and a raised seat, but still have numerous drawbacks. For example, those known bathtubs require electricity when the bather needs to get out of the bath, so that if a power blackout occurs, these are rendered inoperative. Also, such bathtubs require a long period of time for emptying the tub. Some of the existing bathtubs have a poor design that can increase the risk of back pain for caregivers that assist the bather. Also, installing these bathtubs requires significant changes to the existing plumbing of the facility. In addition, this creates a relatively small space for future maintenance of the drain, since these are installed under the existing drain. Moreover, many of these bathtubs have replaced manual sealing with pneumatic sealing systems, to reduce the effort required by the user, such as by using compressors, which besides being very expensive, are also very noisy and run against the principle of a relaxing bath.

Also known are the following patent documents:

U.S. Pat. Nos. 5,163,187 and 5,220,696 (Dannenberg et al.) assigned to Kohler Co., disclose a bathtub with a vertical axis hinged door and an inflatable seal.

US Patent Publication No. 2007067901 and U.S. Pat. No. 7,237,276 (Longman), disclose a bathtub with door movable along a horizontal direction between open and closed positions.

US Patent Publication Nos. 2011167555 and 2012198611 (Zierler et al.), assigned to Artweger GMBH & Co., disclose a closing and securing assembly for a bathtub with a water-tight door.

WO2013125477 (Torii et al.), assigned to Sakai Medical Co., discloses lift mechanism for a bathtub with a support for a sitting section and a lift drive section which vertically moves the sitting section along the support.

WO2015198280 (Polo Filisan), assigned to Jacuzzi Europe SPA, discloses a bathtub with a door movable between open and closed positions. The door includes two panels that are hinged together.

U.S. Pat. Nos. 8,230,534; 9,254,066 (Torres et al.) assigned to Aquatic Co.; assigned to Kohler Co., disclose an accessible bathtub with a slide-down door that allegedly provides quick bathtub draining to minimize chilling of the bather. Indeed, a problem with known prior bathtubs is that the person inside such bathtub generally cannot leave the tub after bathing until the tub has fully drained and the door is then opened. As mentioned above, conventional tub draining systems take too long to drain, resulting in a chilling experience for the bather.

U.S. Pat. No. 8,863,323 and Patent publication No. 2015020305 (Knapp et al.) assigned to Kohler Co, discloses a bathtub with a door movable between lowered and raised positions, door position sensors for sensing the position of the door, and a controller in electronic communication with the position sensors for controlling components of the bathtub based on the position of the door.

SUMMARY

According to the present invention, there is provided a bathtub comprising a tub having an enclosure defined by at least one sidewall for holding a water capacity, a doorway on the sidewall for providing access to the tub, a door mountable onto the doorway for holding at least two water levels in the tub, an actuator for moving the door over the doorway allowing a user to move the door between at least three positions including a lowered, an intermediate and elevated positions, a mechanical drain for emptying the tub, a double reservoir for receiving water from the tub through the drain and a door drip, a control interface, door position sensors for detecting intermediate and elevated locking positions of the door, water detection sensors for detecting the water level in the tub and reservoir, a pressure sensor for detecting a pressure in a seal valve of the door, and a controller configured to receive input controls signals from the control interface for security control, receive input door lock position signals from the door position sensors, receive input water detection signals from the water detector sensor, receive input pressure signals from the pressure sensor for sealing the door, send control signals to control a sealing valve of the door, and send control signals for operating a drain valve.

In embodiments, a bathtub according to the present invention addresses the above drawbacks by incorporating innovative solutions and a modern design.

In embodiments, the bathtub has a side opening for receiving a slidable door that is movable at least between lowered and raised positions, and also at least to an intermediate position. The bathtub may include a raised seat.

In embodiments, the bathtub comprises walls defining a contour, in which at least a portion of one or more vertical walls is provided with a door. The bath may be made of a shell which defines an entrance on a portion thereof or on all of one or more vertical walls of the shell.

In embodiments, the bathtub may include at least one door for retaining water in one of its multilevel closed positions, and to provide free passage in its open position.

In embodiments, the door leaves a passage for a bather when in an open position or is closed or partially closed in its various closed levels.

In embodiments, the door has an integrated overflow system allowing the bathtub to meet safety standards and prevent spills regardless of the chosen door position.

In embodiments, the door can be moved in multiple positions, such as a middle position, which helps with bathing an incapacitated person, or washing a child, and in the highest position to contain a maximum water level to allow full relaxation of the bather.

In embodiments, the door, which can be moved to multiple positions, is provided with a frame allowing it to withstand the pressure of different sealing levels.

In embodiments, the door makes a movement from bottom to top in a circular direction, but it could also be a linear direction, an elliptical direction, or a combination of those movements. The inertia of the door due to its weight may be countered or alleviated for the user by means of an assisting device such as a gas cylinder and/or spring. The door could also be motorized with an actuator, a solenoid, a set of counterweights, or other known means for providing a straight linear movement and/or circular movement.

In embodiments, the bathtub includes a controller for managing the automation, safety devices, and an optional user keyboard.

In embodiments, the controller performs a bath sequence analysis of the various states of the system to control both the water supply and the cap closure of the drain.

In embodiments, the controller cuts off the water supply if water is detected in the drain reservoir so as to avoid an overflow of the bathtub.

In embodiments, the bathtub includes an automatic drain that is controlled by the controller.

In embodiments, the controller enables the water supply if the door is opened to permit cleaning of the bath and/or test the water temperature before filling the tub.

In embodiments, the controller allows the closure of the drain hole if the position of the door is not open, if the pressure required for the sealing is attained and maintained, and if the drain tank is detected as empty.

In embodiments, the automatic drain includes a cylinder for lifting a movable plate acting as a plug when it abuts against the drain hole to close the passage of water.

In embodiments, the drain can be operated with water, air or any gas or liquid, while achieve the same result.

In embodiments, the controller has an integrated power pack to allow a delay and for a user to safely get out of the bath, without the disagreement of an automatic open drain in the case of a rapid failure.

In embodiments, the drain could also be used for different door bathtub models, either hinged, counterweight, side slide, or double-axis as well as for conventional baths.

In embodiments, the drain function may also be operated by means of a flexible membrane assembly or a diaphragm, a lifting cushion, or any other similar actuator or lever.

In embodiments, the drain is installed in the same shell of the bathtub but may be installed outside the shell.

In embodiments, the drain is designed so as to be removably installed. The drain can be removed entirely from the interior of the tub by a plumber so as to allow for checking or maintenance of the drain or of the reservoir.

In embodiments, the drain has a round outlet in order to facilitate the molding of the shell, but could be of any shape without affecting the performance.

In embodiments, the drain has a hair filter to reduce the risks of the reservoir becoming blocked or clogged and to reduce its maintenance.

In embodiments, the tub has a drain cover for masking the non-aesthetic portion of the drain, to protect the user from the risk of being pinched by the automatic drain, to distribute the water removal in a way that diminishes swirls and noises and to control the draining speed.

In embodiments, the bathtub includes a buffer zone or reservoir for fast draining and/or rapid filling.

In embodiments, the reservoir allows for draining the tub in less than 30 seconds, eliminating the cooling and discomfort felt by the user in the bathtub, since the user must wait a full or partial drainage (in some type of bath doors) to get out of the bathtub.

In embodiments, the reservoir allows for draining the tub in less than 30 seconds, even if the tub has its highest volume of water possible with no bather in the tub and filled to the overflow.

In embodiments, the bathtub includes a retaining system of the draining mechanism for retaining the drain inside the shell.

In embodiments, the retaining system of the drain mechanism is designed to allow a watertight installation, without silicone, despite different process variations.

In embodiments, the retaining system of the drain mechanism allows it to be easily installed and removed to permit maintenance or a simplified replacement.

In embodiments, the retaining system of the drain mechanism includes fixing rods which move vertically by the clamping of holding bolts. When tightened, the holding bolts lift the fixing rods, which enter into contact with the structure of the bath, the drainage mechanism is then clamped in its position.

In embodiments, the bathtub includes a rapid drain system based on a concept that has long existed in the prior art, such as in DE 3508713 (Hawliczek). The rapid drain system uses a buffer reservoir, but which has been modified to provide an easy access to the drain through a removable drain that may be quickly removed from the inside of the bathtub. Maintenance service costs are very expensive for existing bathtubs of this type. However, by incorporating a fully removable drain installed inside the bathtub and provided with an attachment mechanism that does not require access under the bath like that of typical bathtubs, service costs can be reduced substantially by installing a simple access to the main drain. Once removed, the drain mechanism allows quick replacement in case of malfunction and/or gives way to an opening giving access to the buffer reservoir to a plumber.

In embodiments, the drain is an automatic drain comprising a cylinder for raising a movable plate acting as a cap that closes an opening to prevent passage of water.

In embodiments, the door, unlike others on the market, may be set to at least three positions: open, closed and intermediate or mid-height. An overflow is built into the door so as to always be at a height that is compliant to the industry standards and different plumbing codes. The mid-height of the door provides caregivers a more ergonomic bath when assisting the bather. This mid-height position makes it even possible for a caregiver to be sitting when assisting the bather.

In embodiments, the door is sealed with an expandable seal with textile reinforcement to act as a stop for the door. This design is based in prior art U.S. Pat. No. 3,042,980 (Brinsmade). Such seal is unlike the non-reinforced seal, which is frequently used in the bathroom market such as in U.S. Pat. No. 5,163,187 (Dannenberg et al.). Because at mid-height the upper seal does not contact the door, the textile reinforcement is used to limit the expansion thereof, and thereby avoiding premature wear of the seal.

In embodiments, the bathtub does not require a compressor, but rather uses the water pressure of the residential circuit. This allows to both seal the door and automatically close the drain. A pressure regulator on the line lowers the pressure to ensure a predetermined fixed pressure and reduces the risk of problems in places with high pressure networks. The actuator cap is connected to a normally closed supply valve and normally open drain valve allowing to cut the water supply and to perform drainage in case of power failure. Accordingly, water in the tub is drained automatically in case of power failure.

In embodiments, the double reservoir comprises a single discharge port.

In embodiments, the single discharge port comprises a non-return device preventing the return of water to the door drip.

In embodiments, the controller has several bath conditional protection devices, making it relatively safer compared to bathtubs in the market. The controller allows sealing of the cap if the pressure is not reached in the door sealing system and the water supply is cut if water is present in the reservoir, which prevents a possible overflow in case of blockage of the external drain system. In known bathtubs available in the market, the following sequence is often times observed: first the door is closed, then second, after a predetermined time period, the cap is closed. However, without the first step of closing being conditional upon the second step of closing the cap, problems may arise in case of a component malfunction. Moreover, in general the water supply is usually not controlled in the bathtubs that are currently available on the market.

In embodiments, the followings steps are followed:

the bather sits in the bath or executes a transfer from a wheelchair to the tub;
the bather operates the handle to unlock the door;
the bather controls the lifting of the door to the desired height and releases the handle;
the spring return mechanism locks the door;
the bather presses on a door sealing command;
the door is sealed;
a pressure sensor validates that the door is well sealed;
a water level sensor of the reservoir and drain validates that the reservoir is empty;
the controller closes the tub plug;
the controller lets water pass from the filling source;
the bather can operate the filling, or the controller fills the tub with water having a predetermined temperature;
the bather stops the water to the desired level, or the controller stops the filling source to a predetermined level;
the bather activates the drain by pressing and maintaining the sealing button for about three seconds (the three second time period is to avoid unwanted or accidental drainage);
the controller operates the drain opening;
the tub is emptied into the drain and reservoir in less than 30 seconds;
a water level sensor detects that the tub is empty;
the controller unseals the door;
the bather operates the handle to unlock the door;
the bather lowers the door and releases the handle;
the spring return mechanism locks the door in the open position; and
the bather can get off the tub and get up or execute a transfer to a wheelchair.

In embodiments, the following control sequence is followed:

the control button is held by the user or bather;
the controller checks the position of the door and whether there is water detected in the bath or in the tank;
if a desired condition is not achieved, the LED indicator blinks for 30 seconds or an error code is shown on the digital keyboard;
if the door is open and no water was detected:
the door is brought to the desired height and the handle is released by the bather;
the lock position switch is activated;
the sealing control button is activated by the bather;
the controller activates the sealing valve;
the pressure sensor validates that the door is properly sealed;
the controller closes the drain valve and opens the filling valve;
the controller lets water pass from the filling source;
the bather can operate the filling, or the controller fills the bath with water at a predetermined temperature;
the bather stops the water to the desired level, or the controller shuts down the filling source to a predetermined level by the user;
the water level in the tub is detected;
the sealing button is held for three seconds (to avoid unwanted or accidental drain);
the controller activates the opening of the cap of the drain valve;
the tub empties into the reservoir in less than 30 seconds;
detects the water level in the reservoir;
detects the absence of water in the tub;
the controller activates the opening of the drain valves;
the sensor alerts the controller that the bath is empty;
the controller unseals the door;
the bather operates the handle to unlock the door;
the bather lowers the door and releases the handle;
the spring return mechanism locks the door in its lowest position;
the bather can get off the tub and get up or execute a transfer to a wheelchair.

In embodiments, a status light is illuminated when proper sealing of the door is achieved. When a problem is detected, the status light may blink, or an error code may be displayed on the digital keyboard.

In embodiments, when the pressure sensor detects that a pressure limit is reached, it sends the information to the controller to indicate that the safety step has been reached (it could be used as a switch on the supply valve to reduce the number of "INPUTS" of the controller if single valves are use);

In embodiments, the drain valve for sealing the door can be only two 3-way valves or four single valves if the two actions of the actuator are controlled, or one 3-way valve or two single valves if a spring return actuator is used or for all other custom assembling valves.

In embodiments, the mechanical drain comprises a drain actuator that comprises two valves for controlling the opening and closing of the drain.

In embodiments, the input water valve can be automatically closed to prevent damage if water is detected in the reservoir. The water valve may close the tap water supply or any other device used to fill the tub.

According to the present invention, there is also provided a mechanical drain for a bathtub, comprising a drain actuator for opening and closing a drain plug on a drain plate, the drain plate being fixable in draining enclosures by means of a retention bracket, a compressed gasket sealing between draining enclosures and the drain plate. In embodiments, the drain actuator comprises two valves, the valves controlling the opening and closing of the drain.

In embodiments, the retention bracket is movable up and down by tightening mounting bolts and adapted to be maintained parallel by means of a guide rod. In embodiments, the mechanical drain comprises a drain cover. In embodiments, the mechanical drain comprises a hair filter.

BRIEF DESCRIPTION OF THE DRAWINGS

The various embodiments disclosed here in will be better understood by way of the following detailed description with reference to the appended drawings, in which.

DETAILED DESCRIPTION

Figure 1:
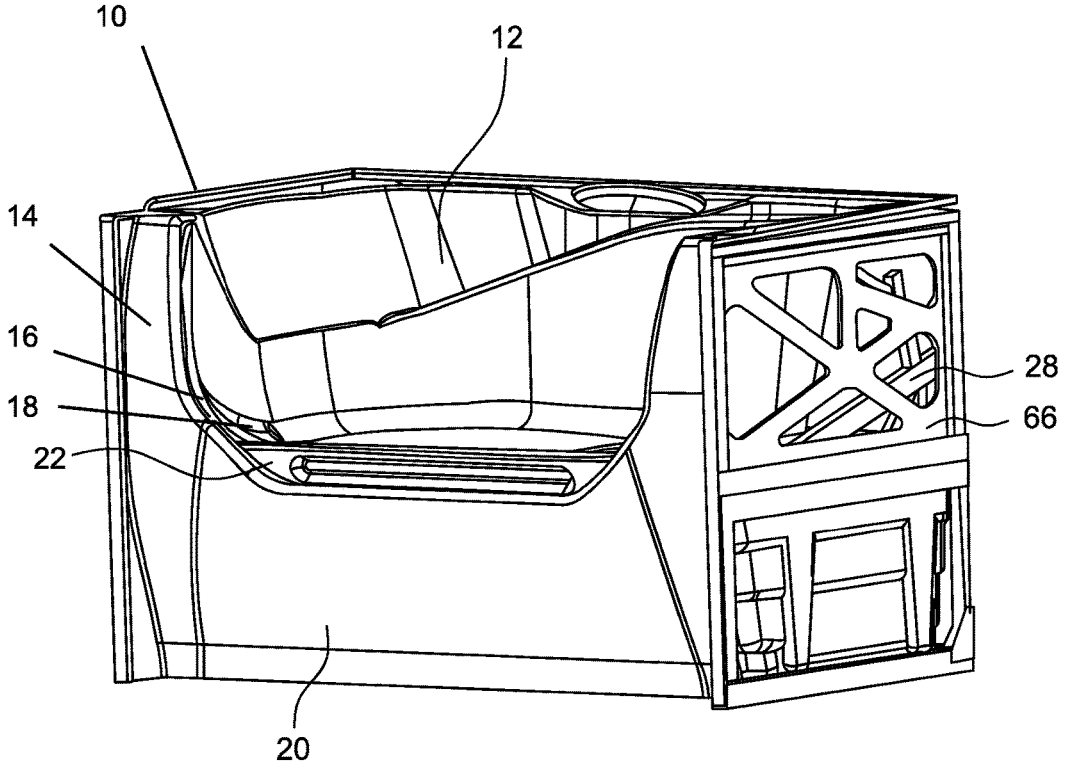
FIG. 1 is a perspective schematic view of a bathtub according to a preferred embodiment of the present invention, showing its door open.
Figure 2:
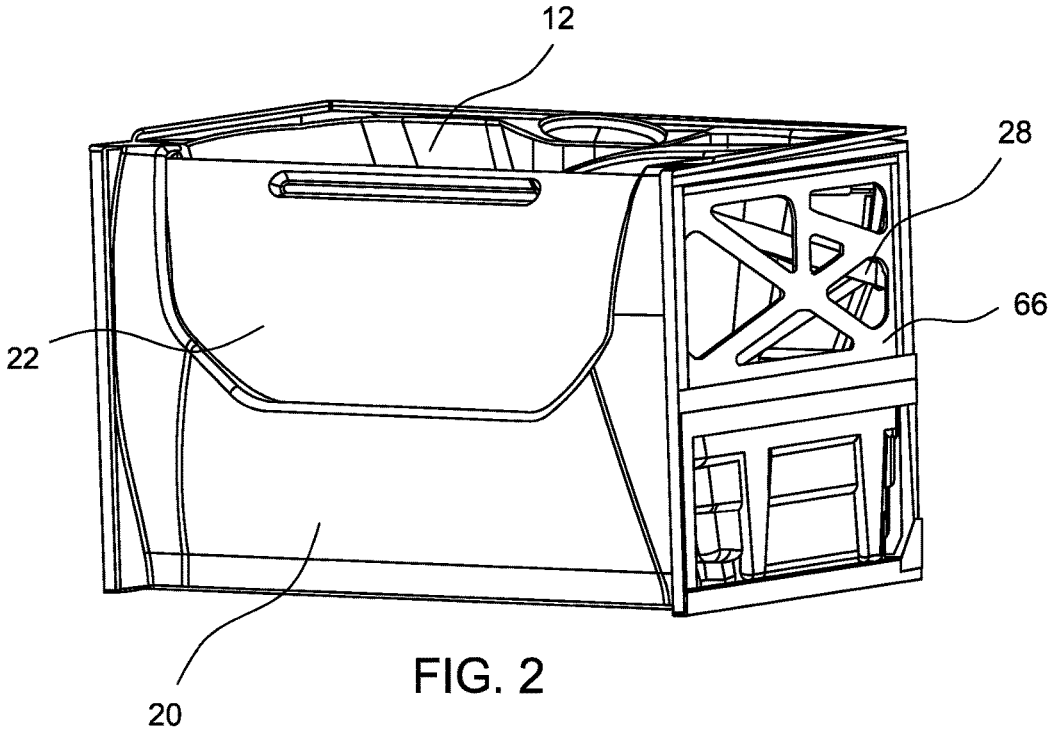
FIG. 2 is another schematic perspective view of the bath shown in FIG. 1, showing the door closed.
Figure 3:
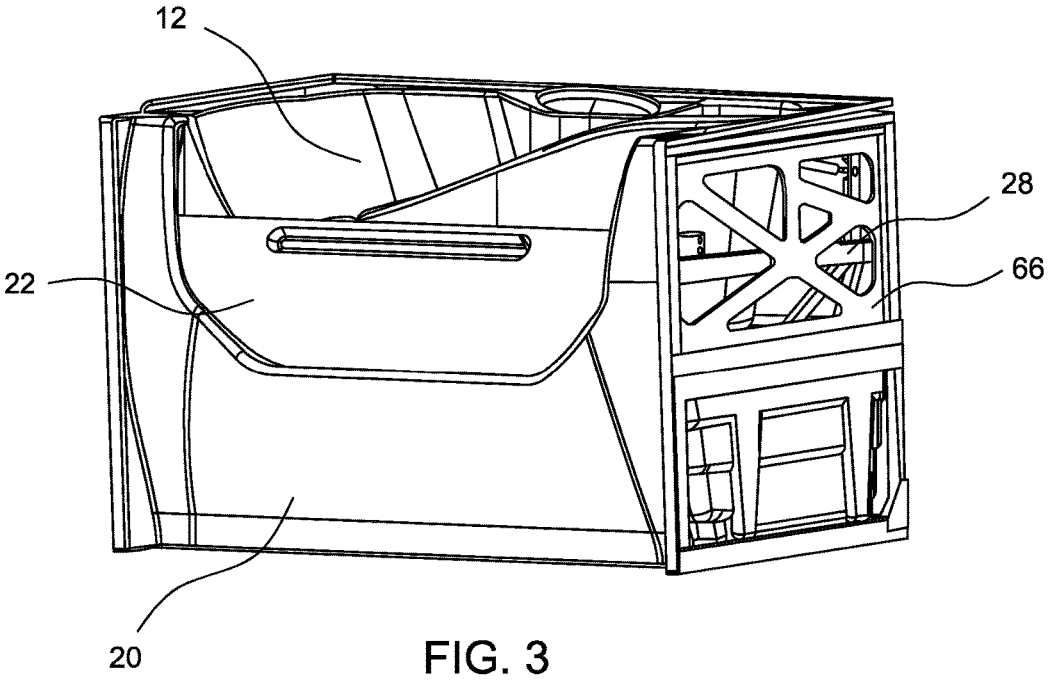
FIG. 3 is another schematic perspective view of the bath shown in FIG. 1, showing the door at mid-height.
Figure 4:
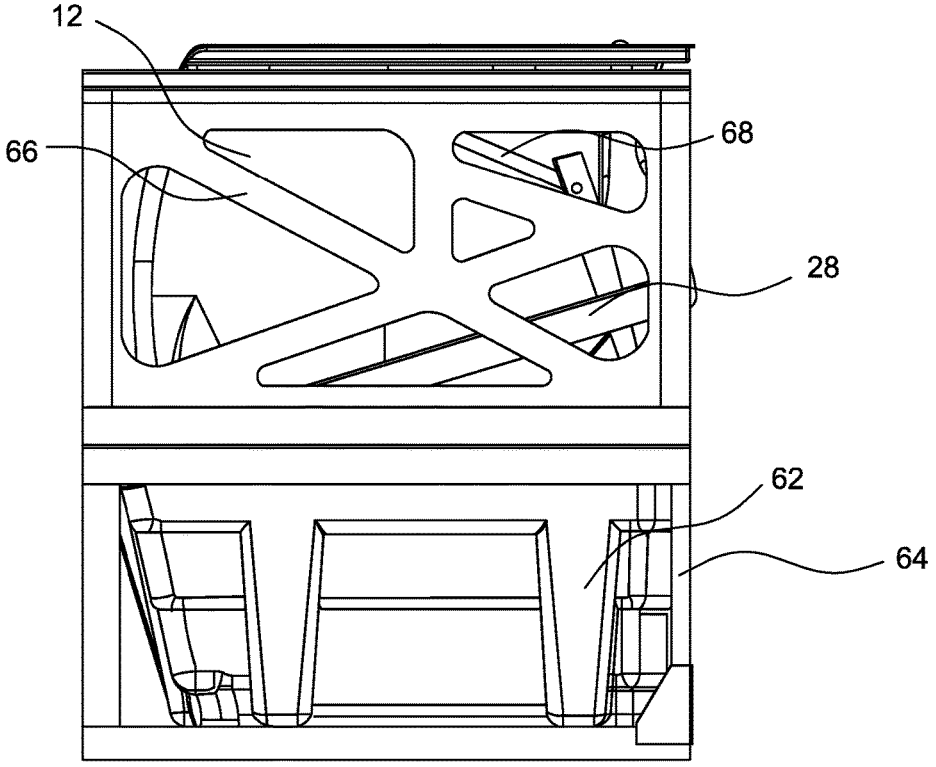
FIG. 4 is a side view schematic view of the bathtub shown in FIG. 1.

Referring to FIGS. 1 to 26, there is shown a bathtub 10 that includes a tub 12 having an enclosure defined by at least one sidewall 14 for holding a water capacity, according to different embodiments of the present invention. The bathtub 10 has a doorway 16 on the sidewall 14 for providing access to the tub 12. A sealing strip 18 is installed on the periphery of a doorway 16. A set of finishing panels 20 are positioned in the front of the bath 10, and are used to mask the sealing strip 18. A door 22 is mountable onto to the doorway 14 for holding at least one water level in the tub 12. The bathtub 10 has a unidirectional double side door lock mechanism 24 for holding the door 22 over the doorway 16 between at least two positions, preferably at least three positions such as a lowered, an intermediate and elevated positions. A receiver door drip 36 is fixed under the door 22 and incorporated to the double reservoir 62, to catch the water in the sealing strip 18 when the door 22 is in the lower position. The door 22 has a door frame 30 to support pressure of the sealing strip 18. The door frame 30 is fixed to the door arms 28, themselves fixed to the pivot axis 26. The pivot axis 26 is fixed to removable structural pivot plates 66, themselves fixed to the tub frame 64 and the gas cylinder 68. The door has a unidirectional lock actioned by the lock rod 70. The door 22 has a door overflow 32 using, for example, a structural overflow pipe. The door overflow 32 allows the door 22 to receive water therein and allows the door 22 to be maintained in any position of the door 22 as it moves up and down. The door overflow 32 function may be achieved in other different ways other than the illustrated structural pipe. Indeed, one may use a flexible tube or pipe or a slidable tube or pipe that follows the movement of the door 22 to achieve the function of the door overflow 32 to control the height of the water level in respect to door 22 heights at a desired level. Alternatively, one or more draining valves may be used to achieve the function of the door overflow 32 to control the height of the water level in respect to door 22 heights at a desired level.

The bathtub 10 also has a frame 64 to hold together the tub 12, the door 22, and the reservoir with double compartment 62. The reservoir with double compartment 62 is equipped with a sewage segregation system 72 that prevents water from the reservoir to the receiver door drip 36. In embodiments, other systems could be used, such as a mechanical trap or a check valve. The sewage segregation system 72 has a reservoir drain 74, a tail piece 76, a segregation pipe 78, and a receiver drain 80.

Figure 5:
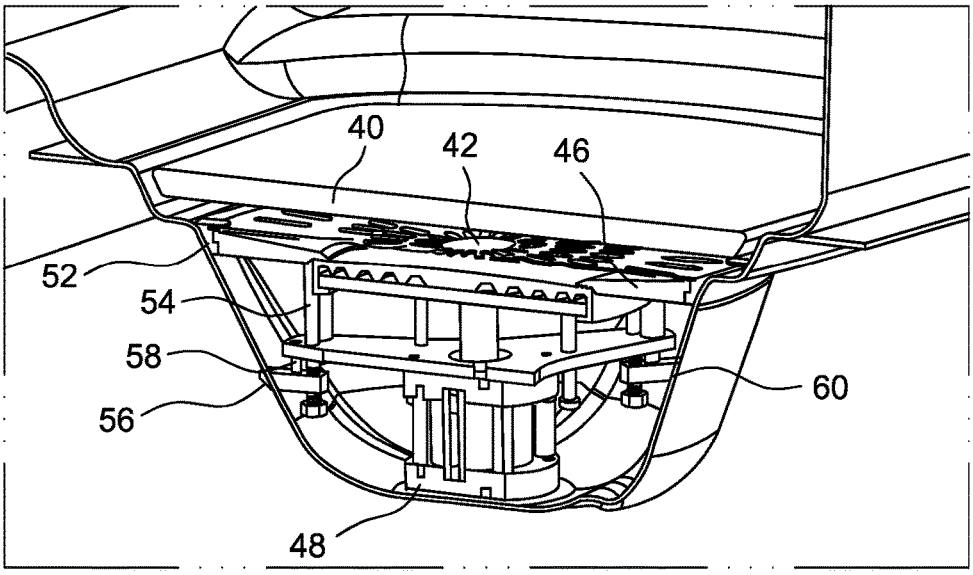
FIG. 5 is a sectional view of a drain in the closed position, used in the bath shown in FIG. 1, according to a preferred embodiment of the present invention.
Figure 6:
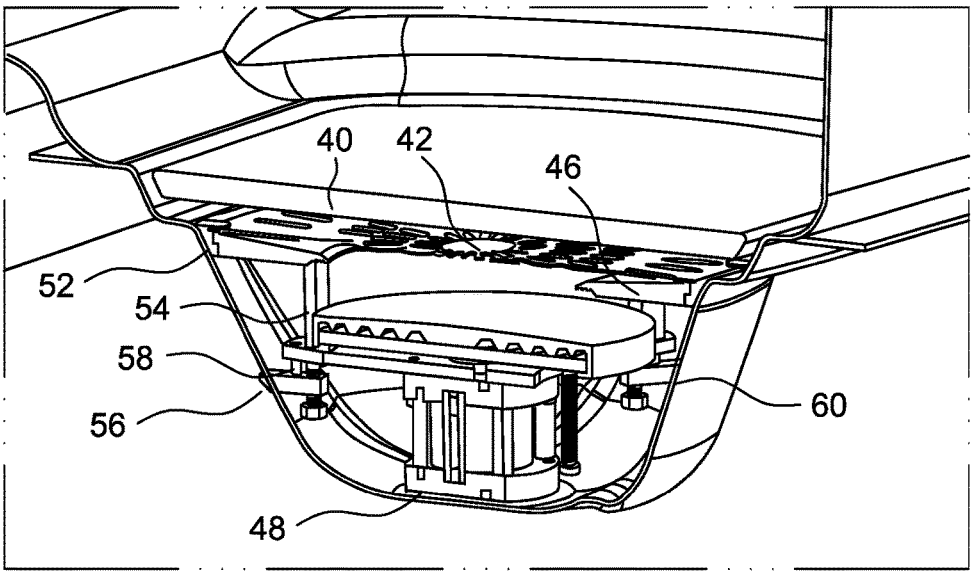
FIG. 6 is another schematic perspective view of the drain of FIG. 5, showing the drain in the opened position.
Figure 7:
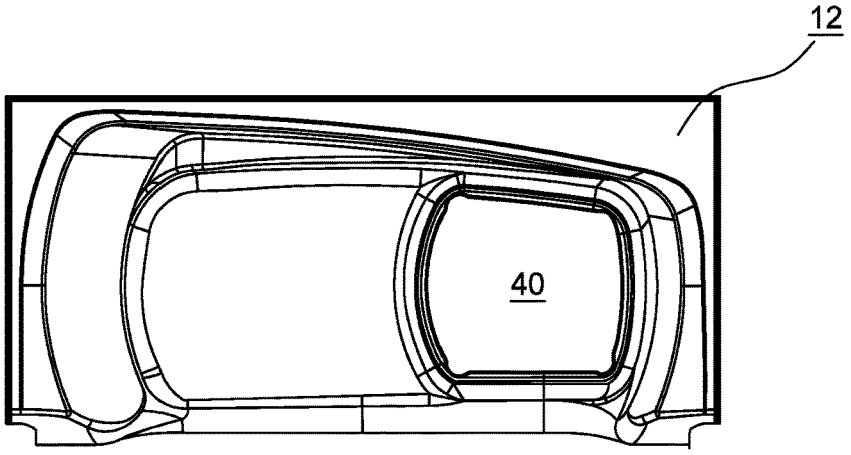
FIG. 7 is a top schematic view of the bathtub shown in FIG. 1.
Figure 8:
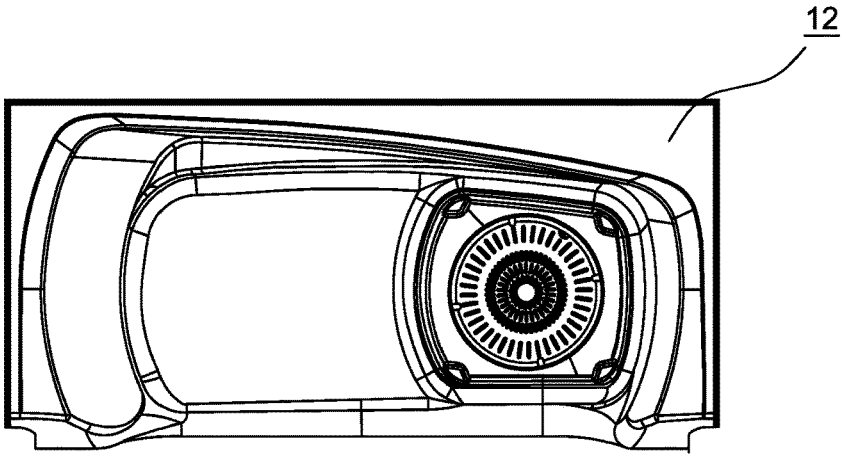
FIG. 8 is another schematic top view of the bathtub of FIG. 7, showing the drain without its drain cover.
Figure 9:
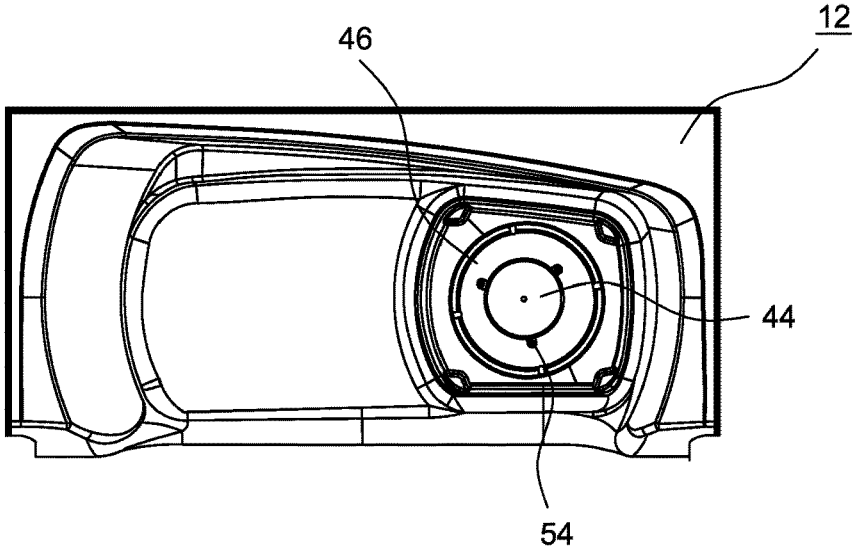
FIG. 9 is another schematic top view of the bathtub of FIG. 8, showing the drain without the hair filter.
Figure 10:
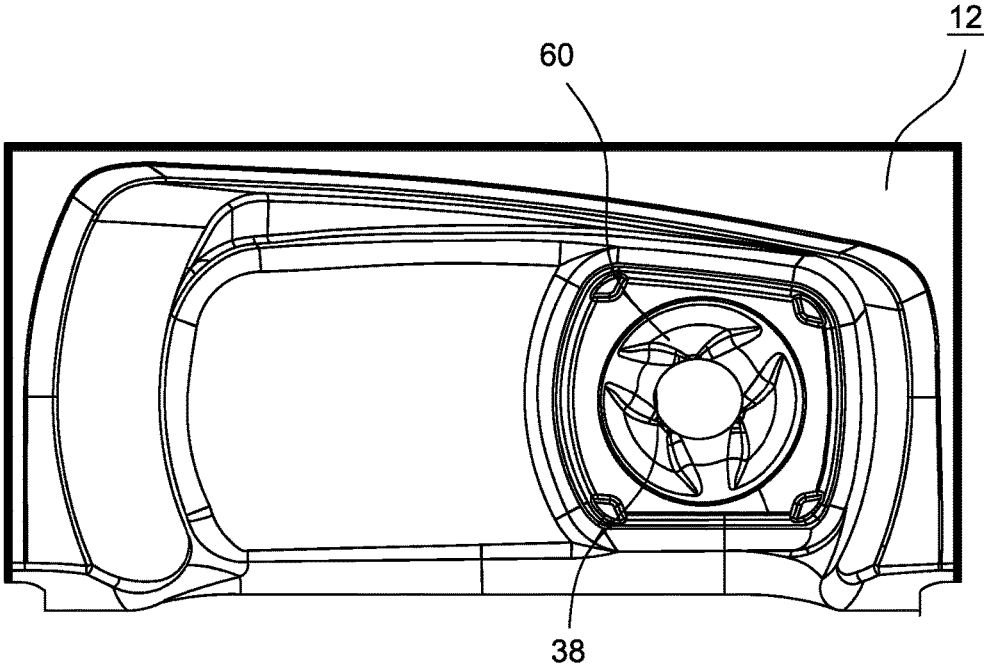
FIG. 10 is another schematic top view of the bathtub of FIG. 9, showing the drain without drain valve assembly.
Figure 11:
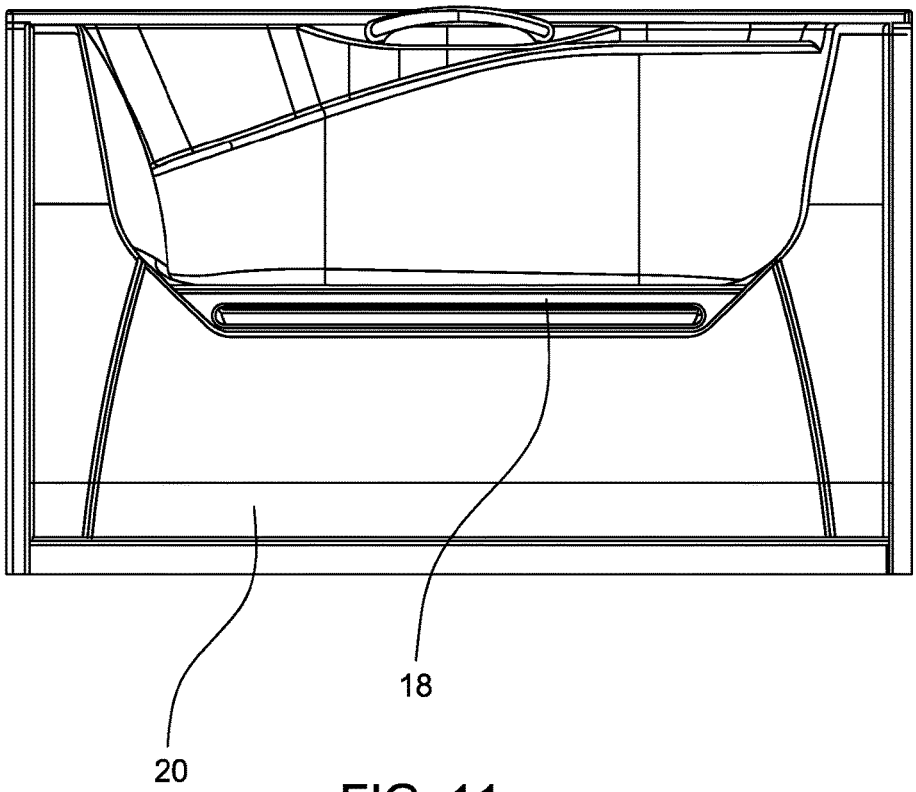
FIG. 11 is a front elevation view of the bathtub shown in FIG. 1.
Figure 12:
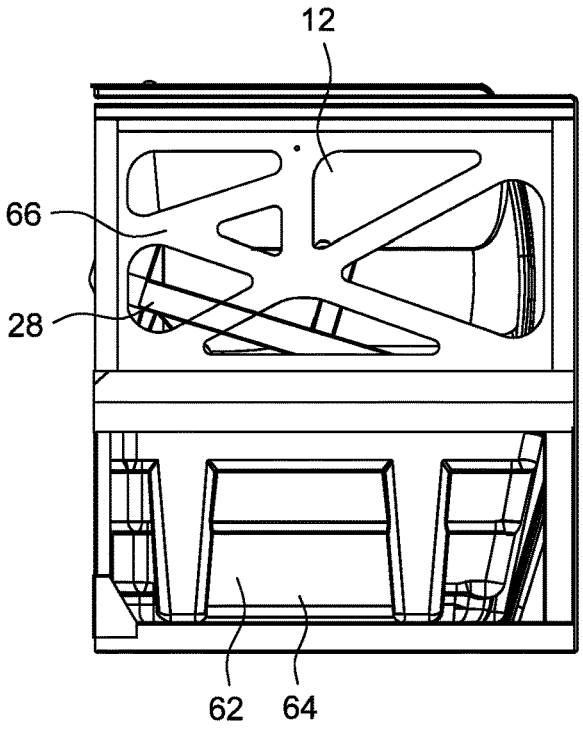
FIG. 12 is a side schematic view of the bathtub shown in FIG. 1.
Figure 13:
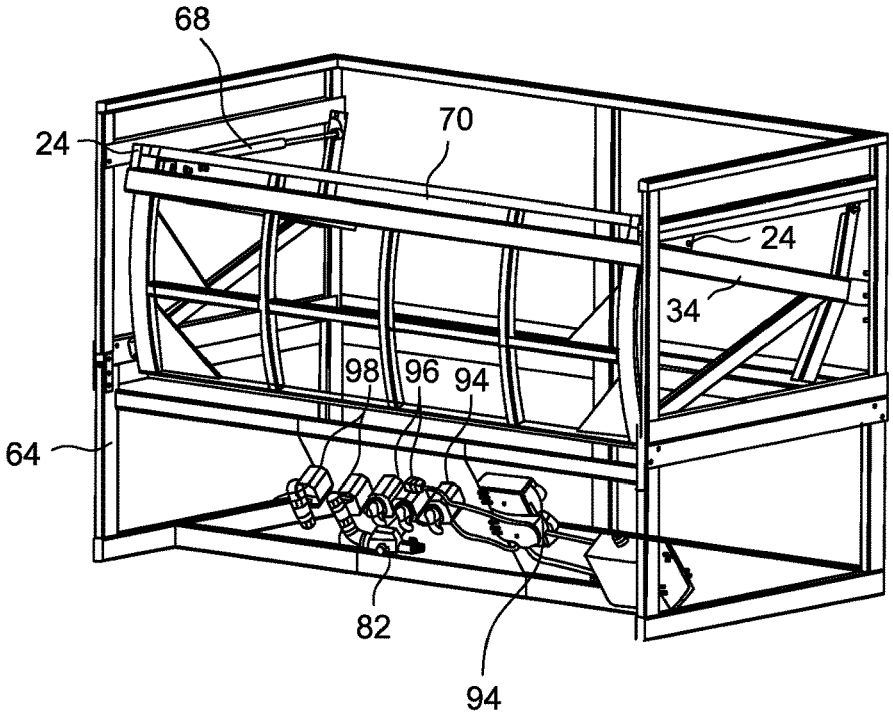
FIG. 13 is a side schematic view of the structural frame of the bathtub shown in FIG. 1.
Figure 14:
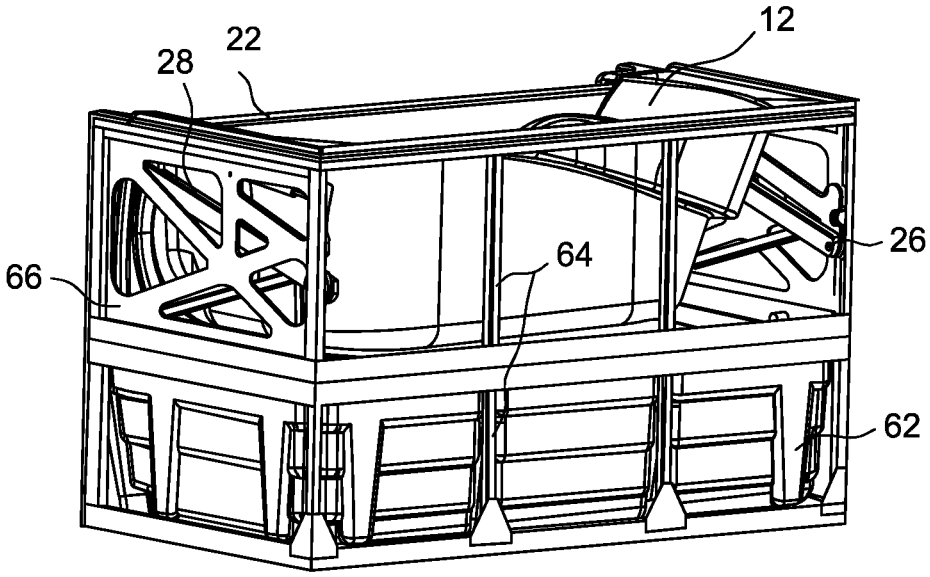
FIG. 14 is a back perspective view of the bathtub shown in FIG. 2.
Figure 15:
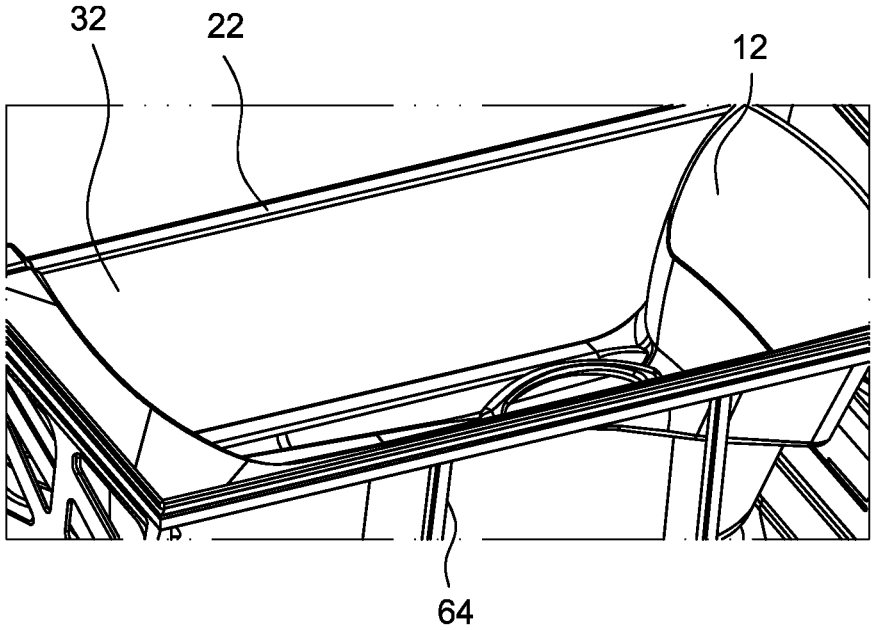
FIG. 15 is another schematic perspective view of the bathtub shown in FIG. 14.
Figure 16:
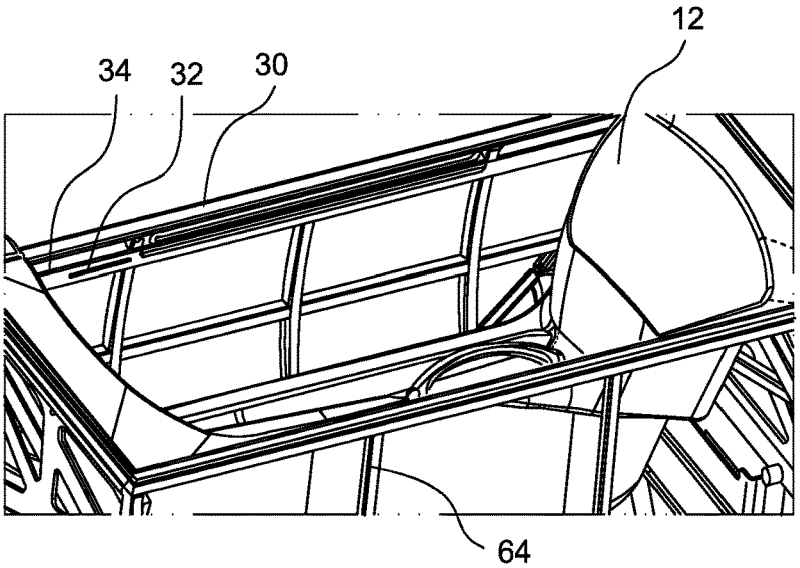
FIG. 16 is another schematic back perspective view of the bathtub shown in FIG. 15, showing the door without finishing panel.
Figure 17:
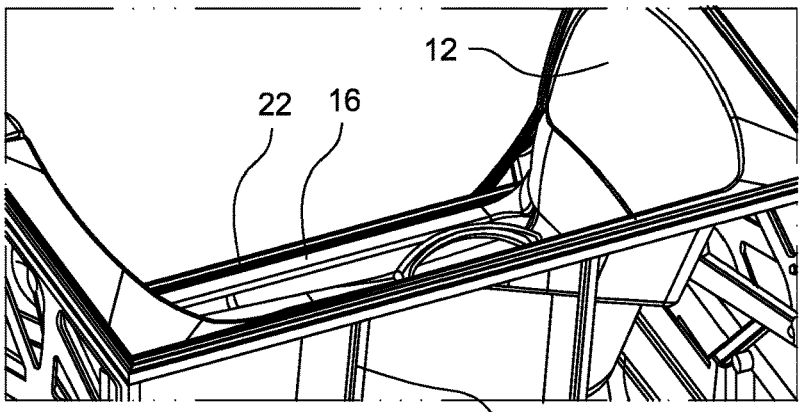
FIG. 17 is another schematic perspective view of the bathtub shown in FIG. 15, showing its door open.
Figure 18:
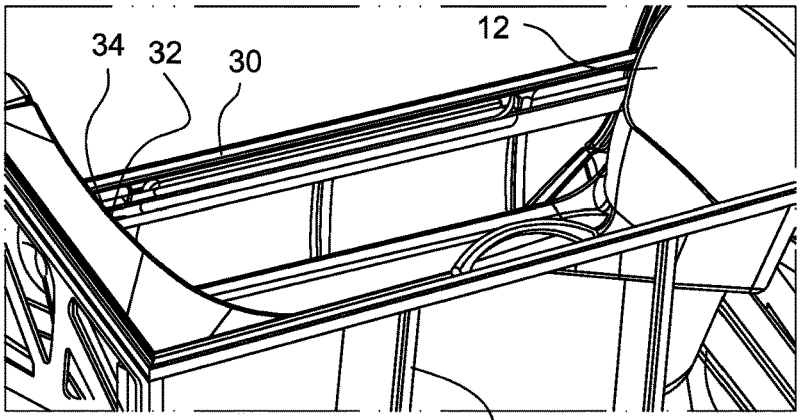
FIG. 18 is another schematic perspective view of the bathtub shown in FIG. 16, showing the door at mid-height.
Figure 19:
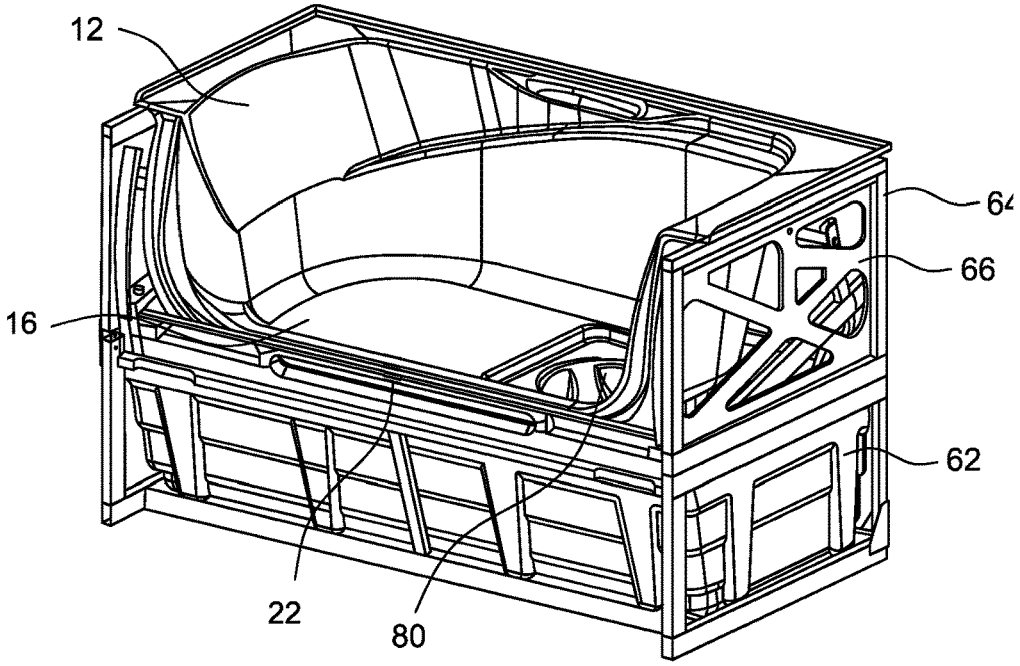
FIG. 19 is another schematic perspective view of the bathtub shown in FIG. 1, showing the bathtub with the door in an open position and finishing panels.
Figure 20:
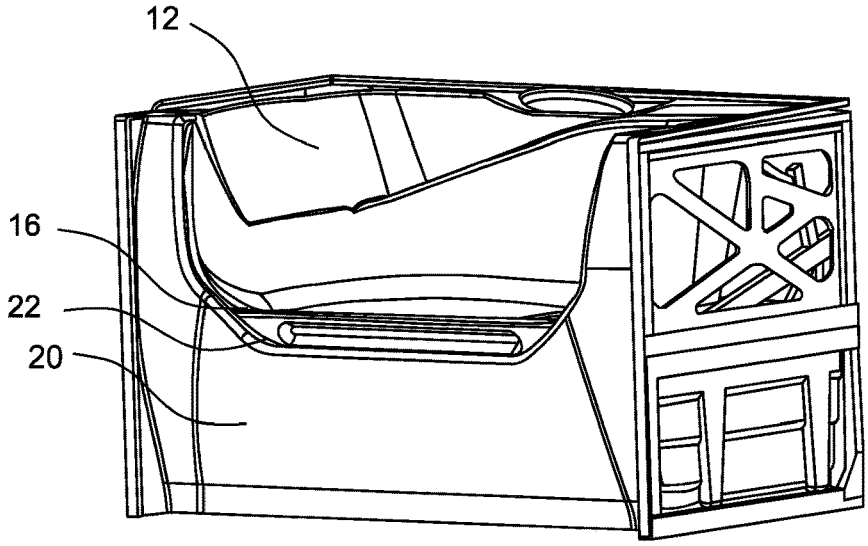
FIG. 20 is a front elevation view of a bathtub according to another preferred embodiment of the present invention, wherein the bathtub is empty of water and its door is in a lowered position.
Figure 21:
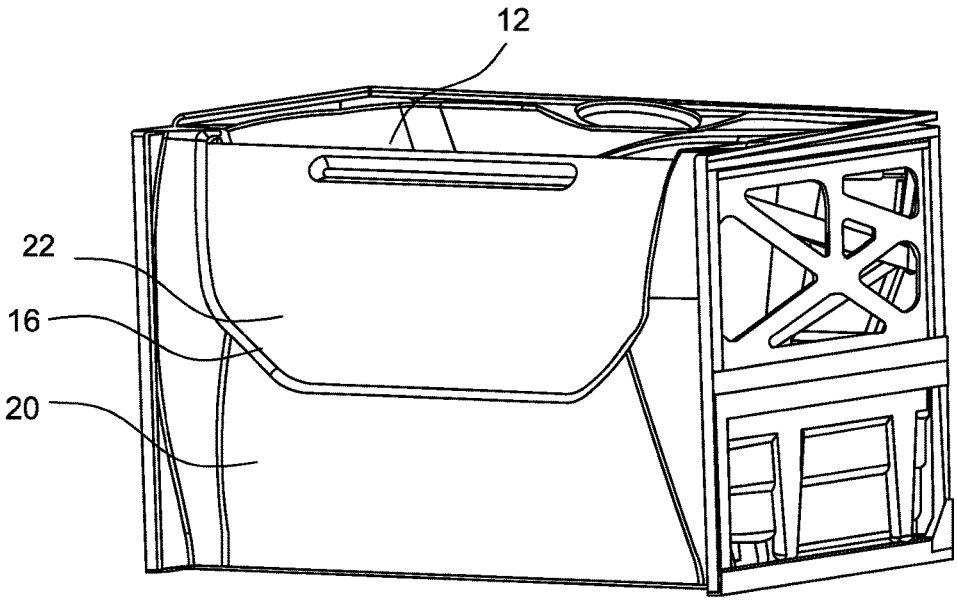
FIG. 21 is a front elevation view of a bathtub according to another preferred embodiment of the present invention, wherein the bathtub is empty of water and its door is in an elevated position.
Figure 22:
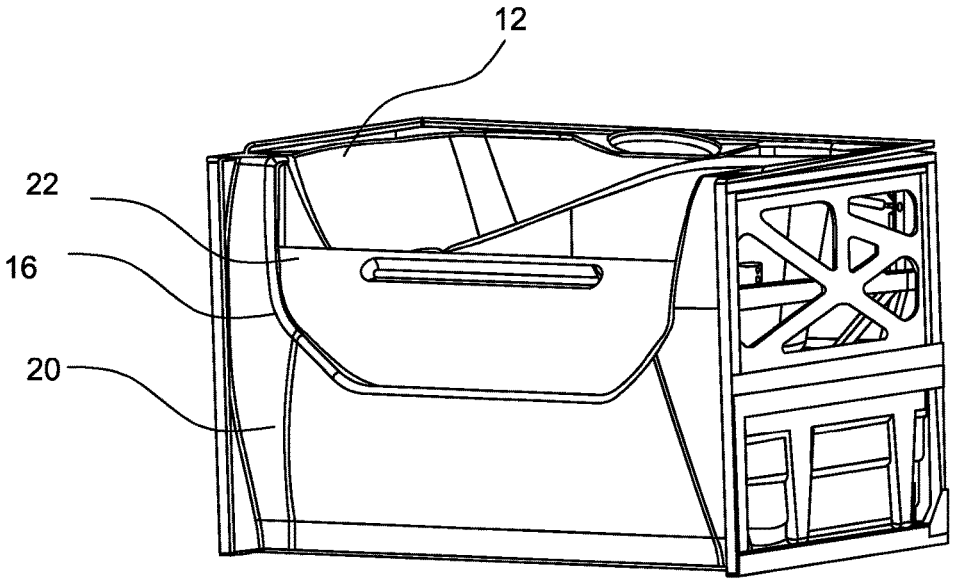
FIG. 22 is a front elevation view of a bathtub according to a preferred embodiment of the present invention, wherein the bathtub is empty of water and its door is in a mid-height position.
Figure 23:
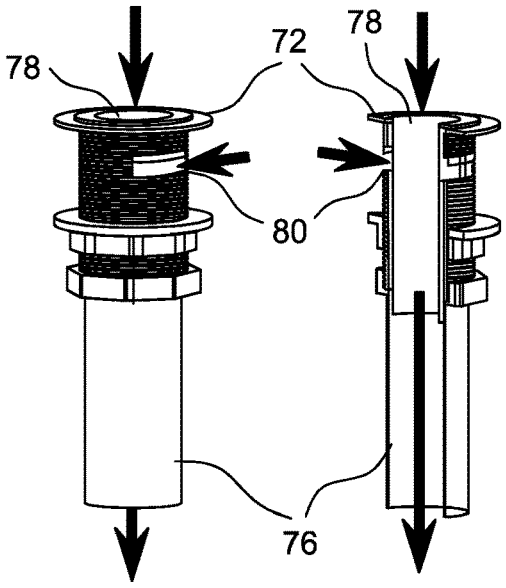
FIG. 23 is a schematic perspective view of the sewage segregation system of the double reservoir.
Figure 24:
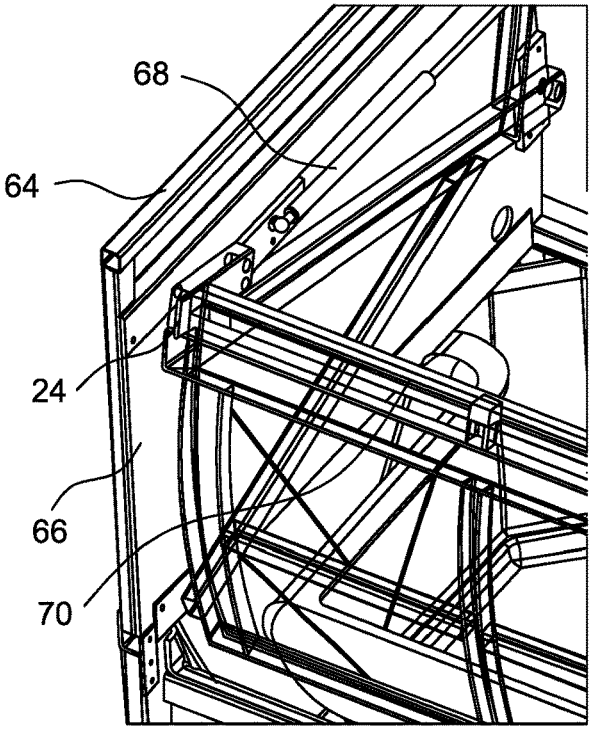
FIG. 24 is a schematic perspective view of the side of the door.
Figure 25:
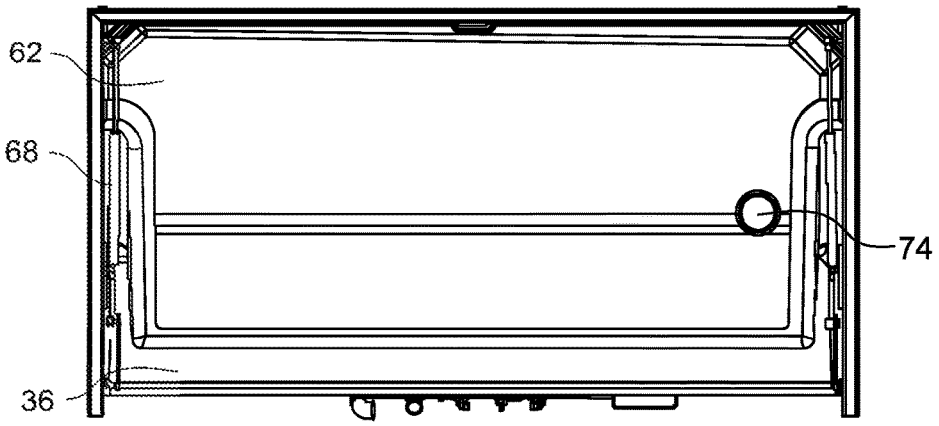
FIG. 25 is a top schematic view of the double reservoir.

The bathtub 10 includes a mechanical drain, as best shown in FIG. 5, for emptying the tub 12. The bathtub 10 may have a reservoir 62 for receiving water from the tub 12 through the hole of drain 38. A tub 12 has a draining enclosure 60 and hole drain 38.

Referring to FIG. 5, the draining enclosures 60 contain the mechanical drain. The mechanical drain has a drain actuator 48 for opening and closing the drain plug 44 on the drain plate 46. The drain actuator 48 may have an integrated spring return, water activation on both sides or an external spring return, managed by the controller 92. The drain plate 46 is fixed in the draining enclosures 60 by the retention bracket 56, the compressed gasket 52 sealing between draining enclosures 60 and the drain plate 46. The retention bracket 56 is movable up and down by tightening the mounting bolts 54 and maintained parallel by the guide rod 58. The mechanical drain also has a drain cover 40 and a hair filter 42.

Figure 26:
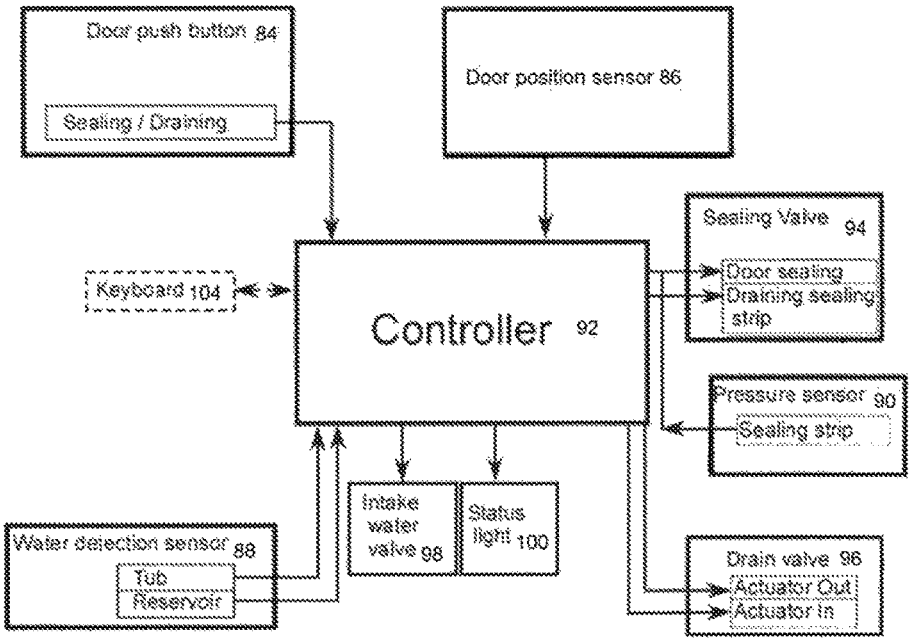
FIG. 26 is a schematic view of a controller of a bathtub and different elements connected to the controller, according to a preferred embodiment of the present invention.

Referring to FIG. 26, in addition to FIGS. 1 to 25, the bathtub 10 includes a door push button 84 used by a user or bather. Also shown are door position sensors 86 for detecting the lowered, intermediate and elevated positions of the door 22. Also shown are water detection sensors 88 for detecting water level in the tub 12 and reservoir 62. Also shown is a pressure sensor 90 for detecting a pressure in the door sealing strip 18. Also shown is a controller 92 configured to: receive input controls signals from the door push button 84; receive input door position signals from the door position sensors 86; receive input water detection signals from the water detector sensor 88; receive input pressure signals from the pressure sensor 90 for sealing the door sealing strip 18; send control signals to control a sealing valve 94 of the sealing strip 18, illustratively at different levels for sealing the door 22; and send control signals for operating a drain valve 96.

The bathtub 10 may include a water supply valve 98 that is connected to the controller 92 for controlling water input into the tub 12. The bathtub 10 may include a status light 100 that is connected to the controller 92 to display a status of the different systems. A keyboard 104 may also be connected to the controller 92.

While the invention has been shown and described with reference to preferred embodiments thereof, it will be recognized by those skilled in the art that various changes in form and detail may be made therein without departing from the spirit and scope of the invention as defined by the appended claims.

The invention claimed is:

1. A bathtub (10) comprising:

a tub (12) having an enclosure defined by at least one sidewall (14) for holding a water capacity;

a doorway (16) on said sidewall (14) for providing access to the tub (12);

a door (22) mountable onto said doorway (16) for holding at least two water levels in the tub (12);

an actuator for moving the door (22) over the doorway (16) allowing a user to move the door (22) between at least three positions including a lowered, an intermediate and elevated positions;

a mechanical drain for emptying the tub (12);

a double reservoir (62) for receiving water from the tub (12) through the drain and a door drip (36);

a control interface (92);

door position sensors (86) for detecting intermediate and elevated locking positions of the door (22);

water detection sensors (88) for detecting the water level in the tub (12) and reservoir (62);

a pressure sensor (90) for detecting a pressure in a seal valve of the door; and a controller (92) configured to:

receive input controls signals from the control interface for security control;

receive input door lock position signals from the door position sensors (86);

receive input water detection signals from the water detector sensor (88);

receive input pressure signals from the pressure sensor (90) for sealing the door;

send control signals to control a sealing valve (94) of the door (22); and send control signals for operating a drain valve (96).

2. The bathtub of claim 1, further comprising a water supply valve (98) connected to the controller (92).

3. The bathtub of claim 1, further comprising a status light (100) connected to the controller (92).

4. The bathtub of claim 1, further comprising a door push button (84) connected to the controller (92).

5. The bathtub of claim 1, further comprising a keyboard (104) connected to the controller (92).

6. The bathtub of claim 1, wherein the door drip (36) is incorporated in the double reservoir (62) and fixable under the door (22) to catch the water in a sealing strip (18) when the door (22) is in the lower position.

7. The bathtub of claim 1, wherein the door (22) has a door overflow (32), the door overflow (32) using one or more of a structural overflow pipe, flexible tubes, slidable tubes and at least one draining valve.

8. The bathtub of claim 1, wherein the mechanical drain is removably installable from an inside of the tub (12).

9. The bathtub of claim 7, wherein the mechanical drain is adapted to empty the tub (12) in less than 30 seconds.

10. The bathtub of claim 1, wherein the door (22) is movable in an elliptical and/or circular and or linear movement and or combinations thereof.

11. The bathtub of claim 1, wherein the door (22) is sealed by using a textile reinforced sealing strip (18).

12. The bathtub of claim 1, wherein the double reservoir (62) comprises a single discharge port.

13. The bathtub of claim 12, wherein the single discharge port comprises a non-return device preventing the return of water to the door drip.

14. The bathtub of claim 1, wherein the actuator is a solenoid.

15. The bathtub of claim 1, wherein the mechanical drain comprises:

a drain actuator (48) for opening and closing a drain plug (44) on a drain plate (46), the drain plate (46) being fixable in draining enclosures (60) by means of a retention bracket (56), a compressed gasket (52) sealing between draining enclosures (60) and the drain plate (46).

16. The bathtub of claim 15, wherein the drain actuator (48) comprises two valves, the valves controlling the opening and closing of the drain.

17. The bathtub of claim 15, wherein the retention bracket (56) is movable up and down by tightening mounting bolts (54) and adapted to be maintained parallel by means of a guide rod (58).

18. The bathtub of claim 15, wherein the mechanical drain further comprises a drain cover (40).

19. The bathtub of claim 15, wherein the mechanical drain further comprises a hair filter (42).

20. A mechanical drain for a bathtub, comprising:

a drain actuator (48) for opening and closing a drain plug (44) on a drain plate (46), the drain plate (46) being fixable in draining enclosures (60) by means of a retention bracket (56), a compressed gasket (52) sealing between draining enclosures (60) and the drain plate (46).

21. The mechanical drain of claim 20, wherein the drain actuator (48) comprises two valves, the valves controlling the opening and closing of the drain.

22. The mechanical drain of claim 20 or 21, wherein the retention bracket (56) is movable up and down by tightening mounting bolts (54) and adapted to be maintained parallel by means of a guide rod (58).

23. The mechanical drain of claim 20, further comprising a drain cover (40).

24. The mechanical drain of claim 20, further comprising a hair filter (42).

* * * * *